US009526333B1

(12) United States Patent
Nielson

(10) Patent No.: US 9,526,333 B1
(45) Date of Patent: Dec. 27, 2016

(54) MODULAR STORAGE SYSTEM

(71) Applicant: Kevin W. Nielson, Regina (CA)

(72) Inventor: Kevin W. Nielson, Regina (CA)

( * ) Notice: Subject to any disclaimer, the term of this patent is extended or adjusted under 35 U.S.C. 154(b) by 0 days.

(21) Appl. No.: 15/062,873

(22) Filed: Mar. 7, 2016

(51) Int. Cl.

| | |
|---|---|
| ***A47B 47/00*** | (2006.01) |
| ***F25D 23/02*** | (2006.01) |
| ***A47B 95/02*** | (2006.01) |
| ***A47B 96/18*** | (2006.01) |

(52) U.S. Cl.
CPC ..... *A47B 47/0091* (2013.01); *A47B 95/02* (2013.01); *A47B 96/18* (2013.01); *F25D 23/028* (2013.01); *A47B 2095/026* (2013.01)

(58) Field of Classification Search
CPC ..... A47B 47/0091; A47B 95/02; A47B 2095/026; A47B 96/18; A47B 45/00
See application file for complete search history.

(56) References Cited

U.S. PATENT DOCUMENTS

| | | | | |
|---|---|---|---|---|
| 3,811,728 | A | 5/1974 | Redemske | |
| 4,192,562 | A | 3/1980 | Bishoff et al. | |
| 4,728,158 | A | 3/1988 | D'Elia et al. | |
| 5,147,120 | A * | 9/1992 | Ray | A47B 17/00 211/194 |
| 5,997,112 | A * | 12/1999 | Karten | A47F 5/10 312/140.2 |
| 6,193,340 | B1 * | 2/2001 | Schenker | A47B 47/0075 312/108 |
| 6,386,381 | B2 | 5/2002 | Csiszar | |
| 6,764,144 | B2 | 7/2004 | Insalaco et al. | |
| 7,100,999 | B2 | 9/2006 | Stravitz | |
| D533,978 | S | 12/2006 | Hawes | |
| D533,979 | S | 12/2006 | Hawes | |
| D619,829 | S | 7/2010 | Zalewski et al. | |
| 8,186,776 | B2 | 5/2012 | Zalewski | |
| 8,888,199 | B2 | 11/2014 | Vogl et al. | |
| 9,101,212 | B2 | 8/2015 | De Roeck | |

(Continued)

FOREIGN PATENT DOCUMENTS

| | | |
|---|---|---|
| CN | 2365969 | 3/2000 |
| CN | 203509306 | 7/2013 |
| WO | 2015041724 | 3/2015 |

OTHER PUBLICATIONS http://www.cmci.com/Tricons-Triconll.aspx.
http://www.cmci.com/products/standard-platforms/6_5-tricon.

*Primary Examiner* — Daniel Rohrhoff
(74) *Attorney, Agent, or Firm* — Kyle R. Satterthwaite; Ryan W. Dupuis; Ade & Company Inc.

(57) ABSTRACT

A modular storage system employs flat-sided container modules that each have door/lid access on multiple sides thereof and are stackable atop one another in a stable manner by cooperating recesses and feet at the lid and bottom of the container module respectively. Securing clips can be employed to secure adjacent container modules together in various relative positions using pre-defined sets of clip-accommodating grooves in walls of the container modules. Accessories include a table-top module for creating a flat uninterrupted workspace atop a container module, a cooler tray insert for ice-cooled storage of food or beverage items within a container module, a vacuum sealed bag insert for collapsed air-tight storage within the container module, and shelving rack modules cooperatively stackable with the container modules for additional storage flexibility.

20 Claims, 13 Drawing Sheets

(56) References Cited

U.S. PATENT DOCUMENTS

| | | | | |
|---|---|---|---|---|
| 2002/0125799 | A1* | 9/2002 | Landsberger ..... | A47B 47/0091 312/209 |
| 2002/0185941 | A1 | 12/2002 | Ferraro et al. | |
| 2003/0222545 | A1 | 12/2003 | Stravitz | |
| 2005/0077805 | A1 | 4/2005 | Dalebout et al. | |
| 2005/0144194 | A1 | 6/2005 | Lopez | |
| 2011/0033271 | A1 | 2/2011 | Hanel | |
| 2015/0108880 | A1* | 4/2015 | Chung ..... | A47B 87/0292 312/108 |
| 2015/0320207 | A1* | 11/2015 | Chan ..... | A47B 87/0276 312/108 |
| 2016/0095430 | A1* | 4/2016 | Moyer ..... | A47B 47/0091 312/265.4 |

* cited by examiner

FIG.10A
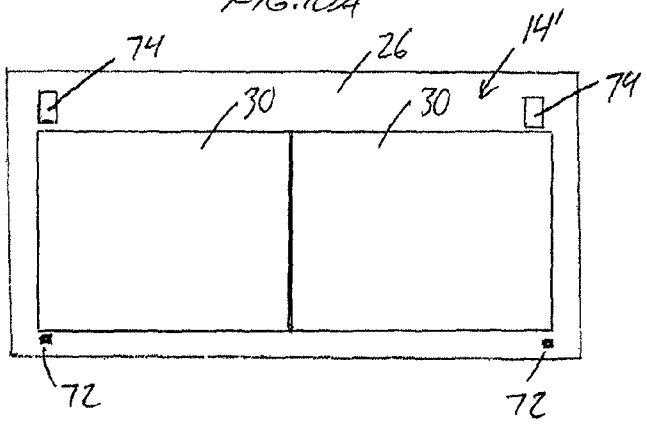
FIG.10B
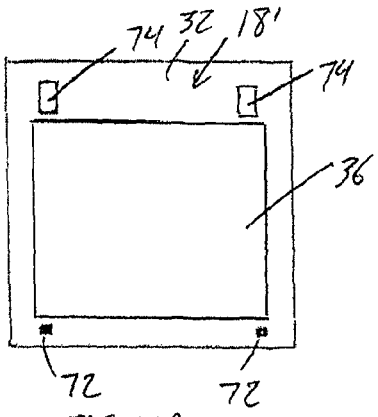
FIG.10C
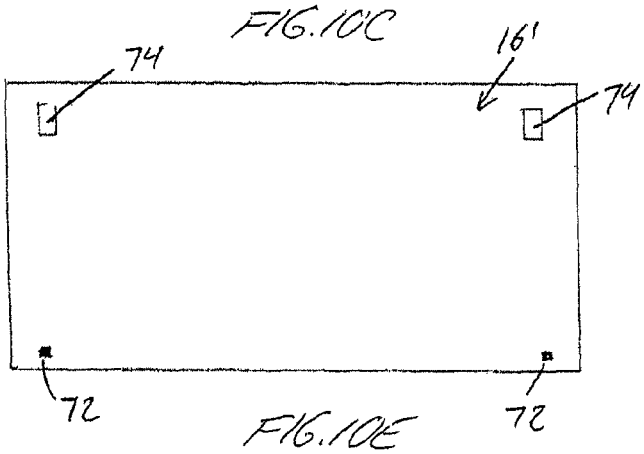
FIG.10D
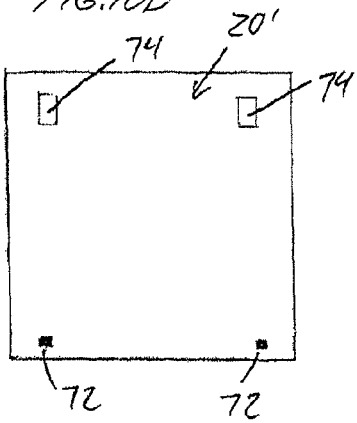
FIG.10E
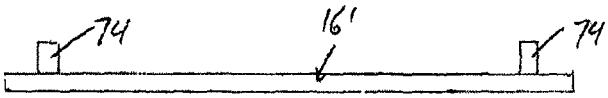
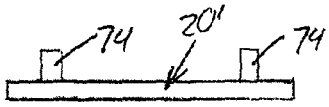
FIG.10F
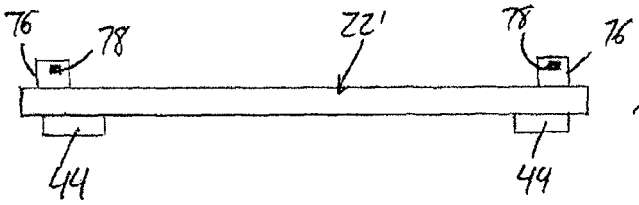
FIG.10G
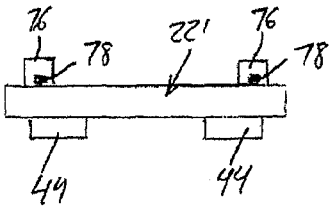
FIG.10H

MODULAR STORAGE SYSTEM

FIELD OF THE INVENTION

The present invention relates to a modular system for storage of household articles or other items.

BACKGROUND

There are many types of storage containers, of which the following three are considered the most pertinent to the present invention.

A common storage container for miscellaneous household and garage items is a stackable plastic or PVC container, sometimes referred to as a tote. These containers come in various sizes and are typically closed on four sides and the bottom. There may be a lid on some storage containers. These portable storage containers can be used for short or long-term storage and are ideal for moving items from one location to another location. They are lightweight yet strong.

Stackable containers may have the ability to nest into each other when not in use. If the container comes with a lid, it can be stacked on top of another similar storage container. Some containers incorporate a structural design into the bottom of one container so that it may securely fit into the top portion of a second container allowing for a stable vertical stacking system if multiple containers are stacked simultaneously. These may or may not have a lid.

A problem with this scenario is that if a user wants to access the lower containers, the top containers must be removed off of the lower containers/lids in order to gain access to the appropriate container. This can be time consuming and laborious. If the storage area is difficult to access or space is limited, this task can be more difficult and time consuming.

To address this problem, users may purchase or build open shelving units or racks. These may be free standing or fixed to a floor or wall. Once shelving units are installed, totes or storage containers can be placed onto the various shelves. This allows for easier access to the storage totes/containers.

A problem with this scenario is that depending on the size of the tote and the limited overhead space between the tote and the shelf above it, there may not be sufficient space to open a hinged lid. If the lid is unhinged and free floating, it can be removed completely and set aside to access the tote through the top opening. But this can be limiting. A user generally has to slide the container forward on the shelf to view into, or to remove items from, the tote or storage container. Or the container may have to be removed from the shelf entirely and moved to the floor to access contents of the container.

An alternate solution is to build or install fixed cupboard units each having a respective door assembly. The door allows for front access to the interior compartment. The benefit is a clear front view of items and ease of access to the items. These cupboards are typically built-in units permanently or semi-permanently affixed to an underlying structure, and not easily moved. They are usually made of composite particle board or wood and are stained or painted. Therefore, these storage solutions are prone to damage if used as a portable container for transporting contents Accordingly, there remains room for improved storage solutions.

SUMMARY OF THE INVENTION

According to one aspect of the invention, there is provided a modular storage system comprising:

a plurality of container modules each comprising a container having:

opposed first and second end walls at opposing ends of the container;

opposed first and second side walls perpendicularly interconnecting the first and second end walls at opposing sides of the container and with said end walls to delimit a rectangular area between said end walls and said side walls, the side walls being longer than the end walls in a direction around a perimeter of the rectangular area;

a bottom wall spanning between the end walls and the side walls at lower ends of said end walls and said side walls; and a top wall residing opposite the bottom wall at a topside of the container and spanning between the end walls and the side walls at upper ends of said end walls and said side walls to cooperate with the bottom wall and the first, second, third and fourth side walls to delimit a rectangular interior volume of the container;

the first end wall comprising an end door movable between open and closed positions respectively opening and closing an end door opening that is located at a respective one of the opposing ends of the container to enable access to the interior volume of the container through said end door opening when said end door is in the open position, said end door opening spanning a majority area of the first end wall;

the first side wall comprising at least one side door movable between open and closed conditions respectively opening and closing a side door opening that is located at a respective one of the opposing sides of the container to enable access to the interior volume of the container through said side door opening when said at least one side door is in the open condition, said side door opening being wider than said end door opening in the direction around the perimeter of the rectangular area, said side door opening spanning a majority area of the first side wall; and the top wall comprising a lid movable between open and closed states respectively opening and closing a lid opening located at the topside of the container to enable access to the interior volume of the container through said lid opening when said lid in the open state, said lid opening spanning a majority area of the top wall of the container;

wherein the rectangular interior volume of each module is accessible via the side door regardless of an obstructed or accessible status of the lid and the end door, is accessible via the end door regardless of an obstructed or accessible status of the lid and the side door, and is accessible via the lid regardless of an obstructed or accessible status of the side door and the end door.

There may be included at least one rectangular rack module having upright frame members at four corners thereof, opposing sides of equal or similar length to the opposing sides of each container module, and opposing ends of equal or similar in length to the opposing ends of each container module, wherein the rack module is open at multiple sides thereof and is stackable with each container module with the four upright frame members of the rack module in general alignment with four corners of the container module.

The rack module may be closed at top and bottom sides thereof by upper and lower plates affixed to the upright frame members.

The rack module with the upper and lower plates may also have at least one rack module door movable between open and closed conditions respectively opening and closing one of the opposing sides of the rack module, wherein the opposing ends of the rack module and the other of the opposing sides of the rack module are doorless to provide permanent openings into the rack module.

Preferably the at least one rack module door comprises two adjacent doors at said one of the opposing sides of the rack module. Preferably the top wall has four corners and a set of recesses opening into the top wall at an exterior side thereof at respective locations situated proximate the four corners of the top wall, and the bottom wall has four corners and a set of protruding feet on an exterior surface of the bottom wall at respective sites situated proximate the four corners of the bottom wall, the set of recesses and the set of protruding feet having aligned positions and matable sizes to enable stacking of the container modules atop one another with the protruding feet of one container module received in the recessed of another container module.

Preferably the upright frame members of the optional rack module have openings at top ends thereof that are sized for receipt of the protruding feet of any one of the container modules and bottom elements that are sized for receipt thereof within the recesses of said any one of the container modules, thereby enabling stacking of the rack module above or below said any one of the container modules.

The upright frame members of the optional rack module may comprise tubing members, hollow interiors of which define the openings at the top ends of said upright frame members, and the bottom elements comprise foot members that have lesser cross-sectional area than said tubing members and that are attached to bottom ends of said tubing members.

There may be provided at least one set of filler units of similar shape and size to the set of recesses in each container module for selective insertion of said set of filler units into the recesses of one of the container modules to occupy said recesses during non-stacking use of said one of the container modules.

There may be provided at least one optional tabletop module having a flat upper surface and an opposing lower surface, and a set of foot members for selective insertion of said set of foot members into the recesses of one of the container modules to occupy said recesses and support the tabletop module in a positioned stacked atop said one of the container modules.

Preferably the end door and the at least one side door comprise flat exterior faces free of any projecting features jutting outward therefrom to enable flush side-to-side, end-to-end and end-to-side placement of adjacent container modules with one another.

Preferably the end door and the at least one side door comprise recessed handles.

Preferably the end door and the at least one side door comprise movable locking members mounted in recessed areas accessible from outside the container and movable between locked positions engaging with frames of the first end wall and first side wall that close around the end wall opening and the side wall opening, and unlocked positions disengaged from said frames to enable locking and unlocking of said end door and said at least one side door.

Preferably the movable locking members comprise slidable thumb latches.

The second end wall and the second side wall may be free of any openable and closable doors, as may be the bottom wall.

A shape of each container module may be a rectangular cuboid, of which the first and second end walls, the first and second side walls, the bottom wall and the top wall are the only exterior walls.

The top wall may consist solely of the lid.

Preferably there are clips arranged for selecting coupling together of any two of the container modules in side-by-side, end-to-end or end-to-side relation by clipping over respective upward-facing edges of adjacent walls of said two of the container modules.

Each clip may have a double-U shape embracing individually over the respective edge of each of the adjacent walls of said two of the container modules.

Each module may comprise clip-accommodating grooves in the end walls and side walls, said grooves reaching downwardly from the upward facing edges at discrete predetermined positions around the rectangular area bound by said end walls and said side wall, the predetermined positions being such that alignment of a selected first groove on one of said two modules with a selected second groove on the other of said two modules places said modules in a predetermined alignment with one another in which the two modules can be secured by engagement of a respective one of the clips with the selected first and second grooves.

There may be at least one cooler insert sized for placement within the rectangular interior volume of the container in a position lining interior surfaces of the end walls, the side walls and the bottom wall with an open upper end of the cooler insert accessible by opening of the lid of the container module, whereby the container module and the cooler insert form a cooler for ice-cooled storage food or beverage items within said cooler insert while maintaining the end walls, the side walls and the bottom wall in a dry state isolated from the ice.

The cooler liner may have an openable/closeable drain port therein.

In one embodiment, each container module comprises an inner rim projecting a short distance into the interior volume of the container from the side walls and the end walls proximate the upper ends thereof, and the cooler insert comprises out-turned flanges at an upper end thereof for catching over the rim of the container module.

Preferably the end walls have flat exteriors, and the container module comprises recessed carry handles recessed into the end walls at the flat exteriors thereof, including a carry handle situated outwardly from the end door in a stationary perimeter-adjacent frame of the first end wall that borders the end door opening therein.

In one embodiment, the bottom wall is defined by a bottom wall panel that is separate and distinct from the side walls and the end walls, said side walls and said end walls being defined by separate and distinct side wall panels and end-wall panels respectively, the bottom wall panel comprising raised fastening bodies protruding from a flat upper surface of the bottom wall panel that defines a floor of the container's rectangular interior volume at positions adjacent to and spaced around a perimeter of the bottom wall panel, and the side wall panels and the end wall panels are joined to the bottom wall panels by fasteners engaged into the fastening bodies of the bottom wall panel through the side wall panels and the end wall panels near the lower ends thereof.

The fastening bodies may feature pre-defined fastener holes and the fasteners comprises threaded fasteners engaged into said pre-defined fastener holes.

In one embodiment, there are four fastening bodies disposed adjacent four corners of the bottom wall panel, each of said four fastening bodies having one of the end wall panels and one of the side wall panels respectively fastened to said fastening body at two different sides of said fastening body.

There may be at least one selectively openable/closable insert unit of a predetermined size selected to occupy a substantial entirety of the rectangular interior volume of the container of any module, the insert unit having an openable/closeable air tight seal by which articles can be placed within said insert unit and stored in an air-tight condition therein within the rectangular interior volume of the module.

The openable/closable insert may comprise a vacuum port by which a vacuum source is connectable to said insert and communicable with an interior thereof to collapse said insert from said predetermined size into a compacted state by evacuation of air from said interior of the openable/closable insert.

BRIEF DESCRIPTION OF THE DRAWINGS

One embodiment of the invention will now be described in conjunction with the accompanying drawings in which:

FIG. 10A is an elevational view of a door-equipped side wall panel of the user-assembled container module of FIG. 9.

FIG. 10B is an elevational view of a door-equipped end wall panel of the user-assembled container module of FIG. 9.

FIG. 10C is an elevational view of a doorless side wall panel of the user-assembled container module of FIG. 9.

FIG. 10D is an elevational view of a doorless end wall panel of the user-assembled container module of FIG. 9.

FIG. 10E is a plan view of the side wall panel of FIG. 10A or FIG. 10C.

FIG. 10F is a plan view of the end wall panel of FIG. 10B or FIG. 10D.

FIG. 10G is a side elevational view of a bottom wall panel of the user-assembled container module of FIG. 9.

FIG. 10H is an end elevational view of the bottom wall panel of FIG. 10G.

In the drawings like characters of reference indicate corresponding parts in the different figures.

DETAILED DESCRIPTION

Figure 1:
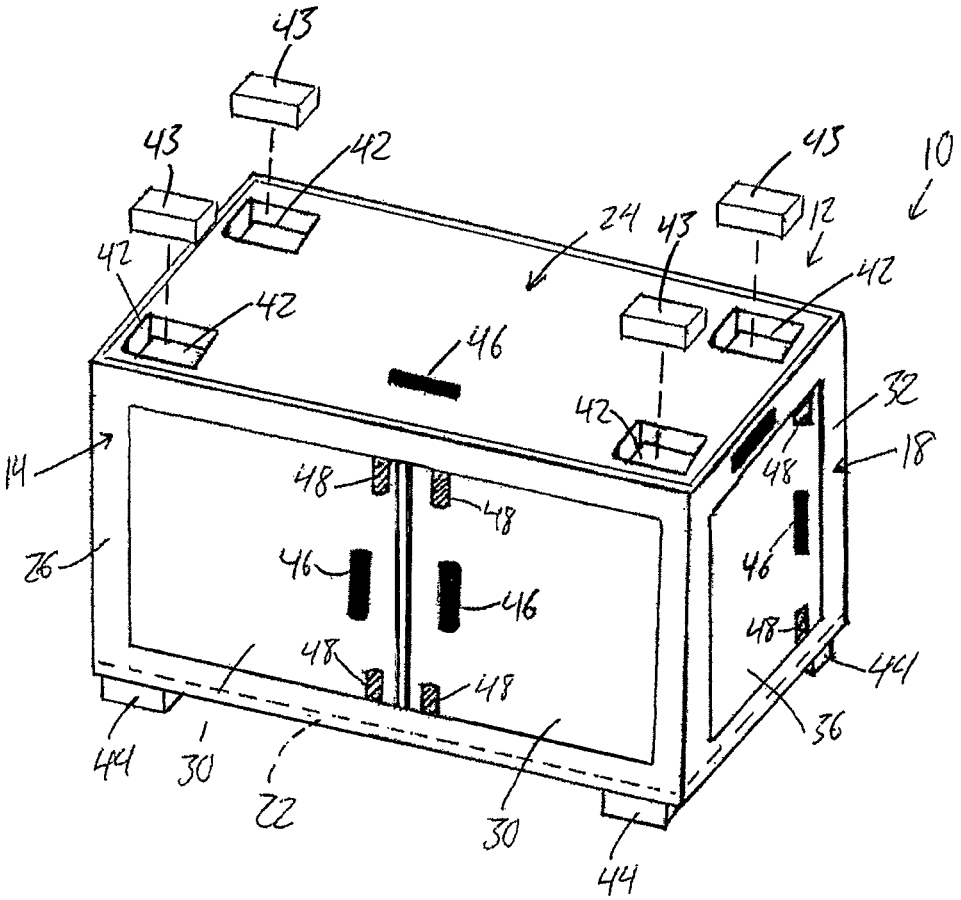
FIG. 1 is a perspective view of a stackable container module featuring a cuboid container whose interior is accessible on three sides via openable/closable doors.

FIG. 1 shows a single container module 10 of a modular storage system according to one embodiment of the present invention. The module 10 features a container 12 having opposed first and second side walls 14, 16 lying in parallel vertical planes, opposed first and second end walls 18, 20 lying in parallel vertical planes that are perpendicular to those of the side walls, a bottom wall 22 spanning horizontally between the end walls and the side walls at lower ends thereof, and a top wall 24 residing opposite and parallel to the bottom wall and spanning between the end walls and the side walls at upper ends thereof. The container is a rectangular cuboid in shape due to the above-described geometric relationship between the walls 14-24 and a rectangular shape of each of these walls 14-24. The side walls 14, 16 and end walls stand upright from the bottom wall 22 along its four perimeter edges in order to delimit a rectangular area atop the bottom wall 22 and thereby cooperate with the top and bottoms walls to delimit a rectangular interior volume of the container. The side walls 14, 16 are longer than the end walls 18, 20 in a direction around the perimeter of the bottom wall's rectangular area. The end walls 18, 20 are therefore spaced from one another in a horizontal length direction of the container that exceeds a horizontal width direction of the container, in which the side walls 14, 16 are spaced from one another.

The first side wall 14 features a rectangular frame 26 defining an outer periphery of the first side wall and closing around a rectangular side door opening in which two side doors 30 are mounted for pivotal movement about respective vertical pivot axes between open and closed conditions that respectively open and close this side door opening. The rectangular side door opening spans a substantial majority of the first side wall's surface area, with the bordering frame 26 occupying only a relatively small fraction of the first side wall's height and length. Accordingly, when the side doors 30 are opened, the rectangular interior space of the container is accessible over a substantial majority or near entirety of its length via the substantially sized side door opening.

The first end wall 18 features a rectangular frame 32 defining the an outer periphery of the first end wall 18 and closing around a rectangular end door opening in which a single end door 36 is pivotally mounted for pivotal movement about a respective vertical pivot axis between open and closed positions that respectively open and close the end door opening. The rectangular end door opening spans a substantial majority of the first end wall's surface area, with the bordering frame 32 occupying only a relatively small fraction of the first end wall's height and length. Accordingly, when the end door 36 is opened, the rectangular interior space of the container is accessible over a substantial majority or near entirety of its width through the substantially sized end door opening 28. In the illustrated embodiment, the end walls 18, 20 are exactly or approximately half as long as the side walls 14, 16, the end door opening is likewise exactly or approximately half as wide as the side door opening, and the end door 36 is exactly or approximately the same width as each one of the two side doors 30. The side wall opening is preferably undivided rather than being divided into two separate doorways behind the two side doors, with the two die doors being hinged near the ends of the container so as to open away from one another, thereby providing entirely unobstructed access to the container space over the entire or substantially-full length thereof. Preferably the end-door is reversibly mounted, i.e. removably mounted for selective hanging at either the left or right side of the end door opening.

Figure 5:
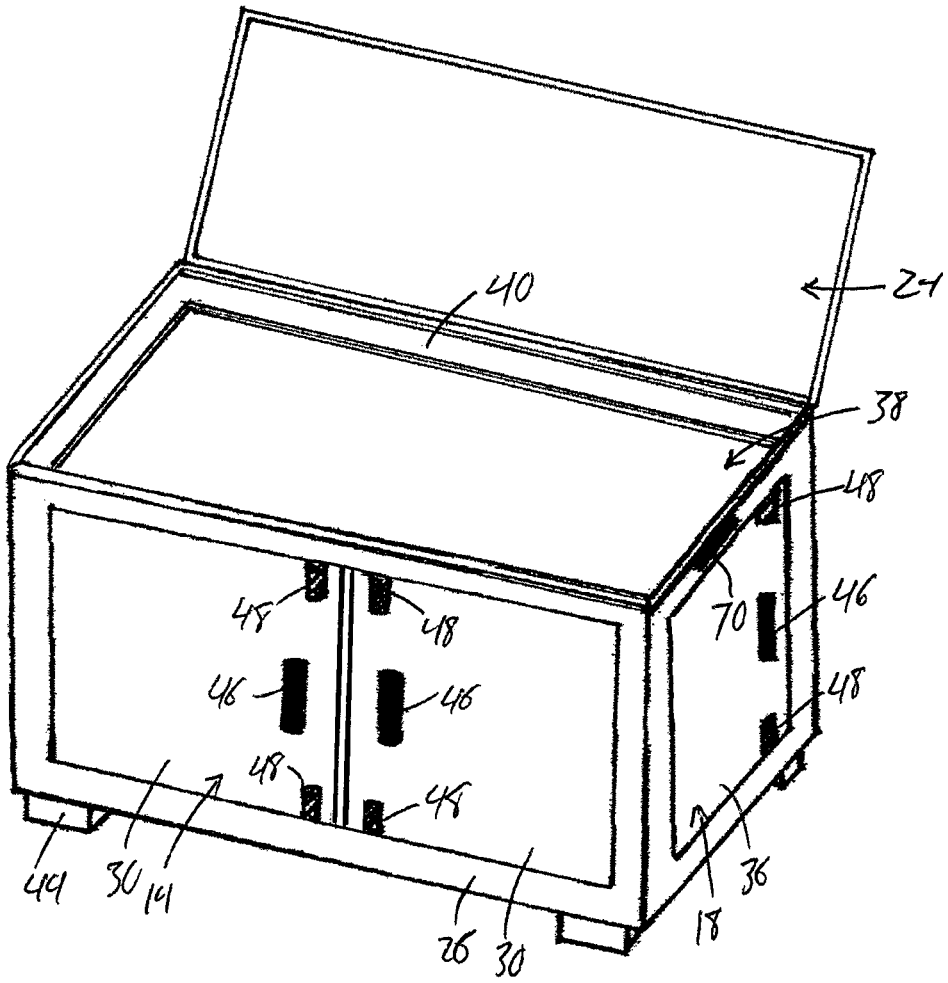
FIG. 5 is a perspective view of the single container module of FIG. 1 with a top-door, or lid, thereof in an open position.

The top wall 24 is a movable lid hinged to the second side wall 14 along the top end thereof for pivotal movement about a horizontal hinge axis between open and closed states that respectively open and close a lid opening 38 that is bound by the top ends of the side walls and end walls 14-20. In its closed state, the lid 24 resides parallel and opposite to the bottom wall 22 and cooperates with the side, end and bottom walls 14-22 to fully enclose the interior space of the container. In the open position shown in FIG. 5, the lid 24 reveals the lid opening 38, thereby providing topside access to the interior space of the container over the entire, or substantially entire, length thereof. As shown, an inner rim 40 may project a short distance into the interior volume of the container from the side walls and the end walls at an elevation proximate to, but spaced slightly below, the top ends of the side and end walls. This enables seating of the lid 24 atop this inner rim 40 in the lid's closed state.

Turning back to FIG. 1, the exterior side of the top-wall/lid 24 features a set of four recesses 42 therein at respective locations situated proximate the four corners of the top-wall/lid 24. Similarly, a set of four protruding feet 44 are provided on the downward-facing exterior surface of the bottom wall at respective sites situated proximate the four corners of the bottom wall 22. The set of recesses and the set of protruding feet having aligned positions and matable sizes in order to enable stacking of container modules atop one another with the protruding feet of one container module received in the recessed of another container module. A set of block-shaped filler units 43 are of similar shape and size to the lid recesses 42 to enable selective insertion of the filler units 43 into the lid recesses 42 of any container module in order to occupy said recesses during non-stacking use of the container module. Each container module may be the sold to the consumer with a respective set of block-shaped filler units 43. While the illustrated embodiment features recesses 42, feet 44 and filler units 43 of rectangular cuboid shape, it will be appreciated that other matable shapes may be employed.

The side doors 30, end door 36 and lid (or top door) 24 all have recessed handles 46 featuring a pocket recessed into the door/lid from the exterior face thereof. Except for its foot-accommodating recesses 42 and the recessed handle 46, the exterior side of the top-wall/lid 24 is planar over its entire remainder. Likewise, except for the protruding feet 44, the entire underside of the bottom wall 22 is planar. The depth of each recess 42 in the lid 24 may be equal to or slightly greater than the height of each protruding foot 44 on the bottom wall 44, whereby the flat exterior surface of the bottom wall 22 of a first container module is seated flat atop the flat exterior side of the lid 24 of a second container module when said first container module is stacked atop the second container module to insert the first container module's bottom 44 feet into the top lid recesses 42 of the second container module. Such configuration distributes the weight of the first module over a greater surface area of the second module. Alternatively, the feet 44 may be slightly taller than the top lid recesses 42 so that the feet weight of the first module is exerted entirely at the lid recesses 42 near the corners of the second module to prevent sagging of the second module's lid 24 at central areas thereof.

Figure 12:
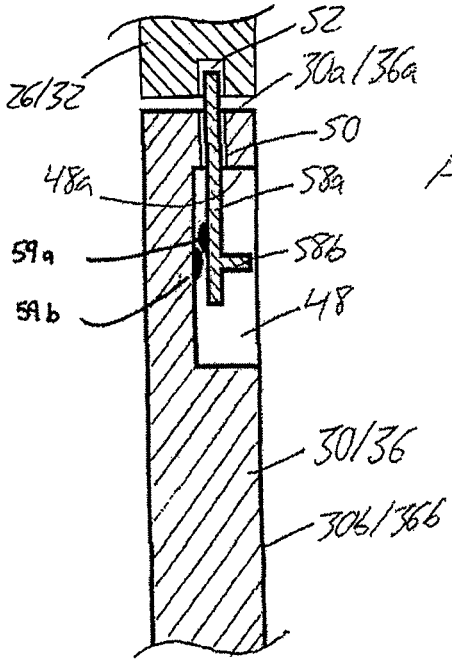
FIG. 12 is a partial cross-sectional view of a door of the container module of FIG. 1, illustrating a recessed thumb-slide locking mechanism thereof.

The side doors 30 and end door 36 each have at least one recessed locking mechanism for securing the door in the closed position. These locking mechanisms are shown schematically without detail in most of the figures, with the exception of FIG. 12, which shows the details of one such locking mechanism. A recessed area 48 at the exterior face of the door 30/36 is positioned near one of either the door's top or bottom edge 30*a*/36*a*. Inside this recessed area 48, a vertical bore 50 opens through an end-wall 48*a* of this recessed area and onward through the door's top or bottom edge 30*a*/36*a*. When the door 30/36 is closed, this bore 50 aligns with a blind hole 52 that is provided in the bordering frame 26/32 that delimits the respective door opening. A thumb latch 58 features a stem 58*a* slidably disposed in the vertical bore 50 of the door 30/36 and a thumb tab 58*b* jutting outwardly from the stem 58*a* near a drive end thereof that resides within the recessed area 48 of the door. The thumb tab 58*b* terminates within the recessed area 48 of the door 30/36 without projecting beyond the flat exterior face 30*b*, 36*b* of the door 30, 36.

A locking end of the stem 58*a* located furthest from the thumb tab 58*b* is suitably sized for selective receipt thereof within the blind hole 52 in the surrounding frame 26/32. When the thumb latch 58 is extended in a locking direction to drive this locking end outwardly from the top or bottom edge of the door into the blind hole 52 of the surrounding frame, the thumb latch thus achieves a locking position in which the locking end of the stem 58*a* blocks movement of the door 30/36, thereby locking the door in the closed position. Sliding the thumb latch 58 in an opposite unlocking direction retracts the locking end of the stem 58*a* inwardly from the top or bottom perimeter edge of the door in order to withdraw the stem 58*a* from the blind hole 52, thereby unlocking the door. When the thumb latch is in the locking position, a retention feature on the thumb latch cooperates with a catch feature to prevent inadvertent withdrawal of the thumb latch from the locking position. In the illustrated embodiment, the retention feature 59*a* on the thumb latch is a raised nodule on a rear side of the thumb latch stem 58*a*, and the catch is a corresponding raised nodule on a boundary wall of the recessed area 48 of the door 30/36. In the thumb latch's locked position shown in FIG. 12, the retention nodule 59*a* resides immediately above the catch nodule 59*b*. The thickness of each nodule (i.e. the dimension thereof by which it is raised from the corresponding surface of the thumb latch or door) is such that the two nodules interfere with one another during sliding movement of the latch. Accordingly, sliding of the latch into and out of the locking position requires application of sufficient manual sliding force to the thumb latch to overcome the resistance caused by the interference between the two nodules. So with reference to the illustrated example of FIG. 12, in which the thumb latch reaches upwardly from the top edge of the door in the locking position, the weight of the latch is insufficient to overcome the sliding resistance provided by the two interfering nodules, thereby preventing the locking end of the latch from gravitationally falling from the blind hole 52 in the frame into the retracted position. Only with sufficient manual application of downward force to the thumb tab will the retention nodule 59*a* slide downwardly past the catch nodule 59*b* to retract the thumb latch and unlock the door.

The thumb latches of the side doors and end door thereby define movable locking members mounted in respective recessed areas that are accessible from outside the container. These locking members are movable between locked positions engaging with frames of the first end wall and first side wall and unlocked positions disengaged from said frames to enable locking and unlocking of the end door and the side doors. The illustrated embodiment features two recessed locking mechanisms per door, one operable at the top perimeter edge of the door to engage the top side of the respective door frame, and the other at the bottom perimeter edge of the to engage the bottom side of the respective door frame. In other embodiments, it may be sufficient to employ only one locking mechanism per door. While the illustrated embodiment lacks such a locking mechanism at the lid 24, which is gravitationally biased into the closed state in the normal upright orientation of the container module, other embodiments may include one or more similar locking mechanisms, which would therefore be operable to lock the lid to one or more of the side and end walls.

In embodiments where the end door is reversibly mounted, for example by having pivot pins at the top and bottom edges door that be engaged in either one of two sets of cooperating vertical holes in the top and bottom parts of the surrounding frame 32 of the end wall 18, the frame 32 of the end wall 18 likewise has multiple sets of blind holes for accommodating reversal of the door's left-handed or right-handed hanging orientation.

Figure 2:
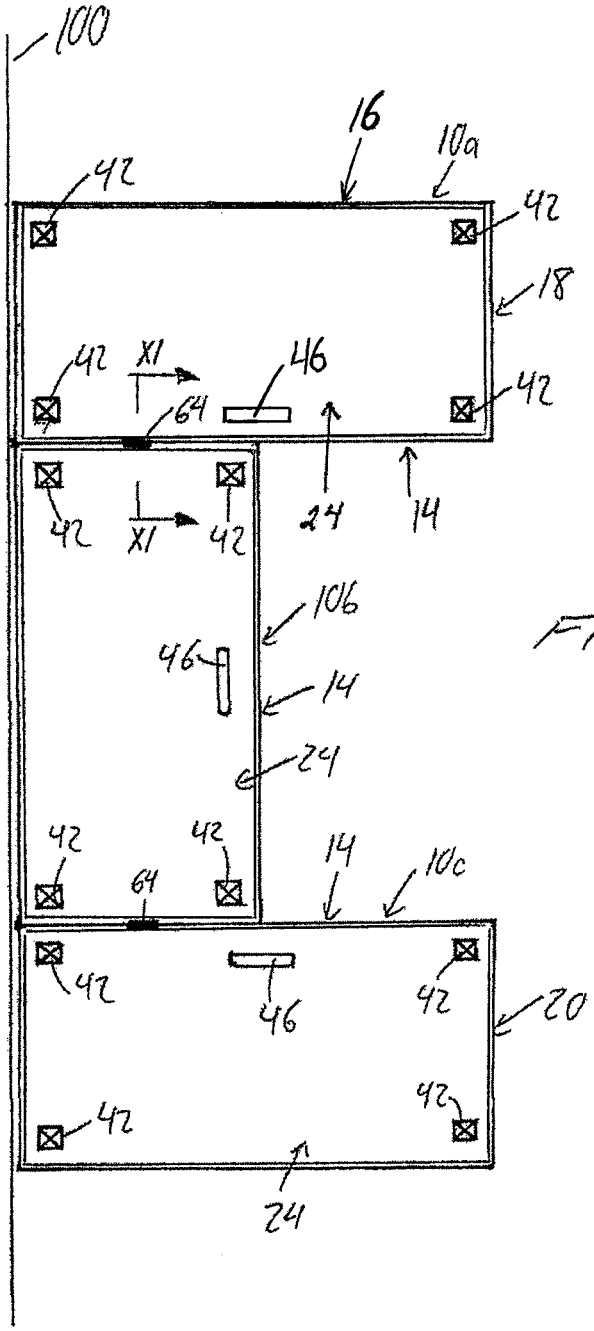
FIG. 2 is an overhead plan view schematically illustrating three container modules clipped together in an unstacked single-level U-shaped configuration.

In the closed position of each door 30/36, the flat exterior face 30*b*, 36*b* thereof is coplanar with the surrounding frame 26/32 of the respective wall of the container module, which is likewise flat at its exterior. Similarly, the doorless second end wall 20 and doorless second side wall 16 are both entirely flat at their exterior. Accordingly, any of the end walls and side walls of one module can be butted flat against any of the end walls and side walls of another module. FIG. 2 shows three modules 10*a*, 10*b*, 10*c* abutted against one another in such a manner to form a U-shaped layout in which a first module 10*a* has its first side wall 14 abutted flat against the first end wall 18 of a second module 10*b*, whose second end wall 20 is abutted flat against the first side wall 14 of a third module 10*c*. The second side wall 16 of the second module 10*b* resides flush with the second end wall 20 of the first module 10*a* and the first end wall 18 of the third module 10*b*, which as shown in the illustrated scenario, may be placed up against a wall 200. The two side doors 30 of the second module 10*b* are thus accessible at a space between the first and third modules 10*a*, 10*c* on the side of the second module facing away from the wall 200. The end doors 36 of the second and third modules 10*b*, 10*c* are not accessible, being blocked by the first module 10*a* and wall 200 respectively. The end door 36 of the first module 10*a* is accessible at the end thereof facing away from the wall 200. In FIG. 2, no additional modules are stacked atop the first three, and access to the interior space of each and every module is available through the openable/closeable lid 24 thereof. One of the two side doors 30 of each of the first and third modules 10*a*, 10*c* is also openable and closable for access to the interior space of these modules.

Figure 3:
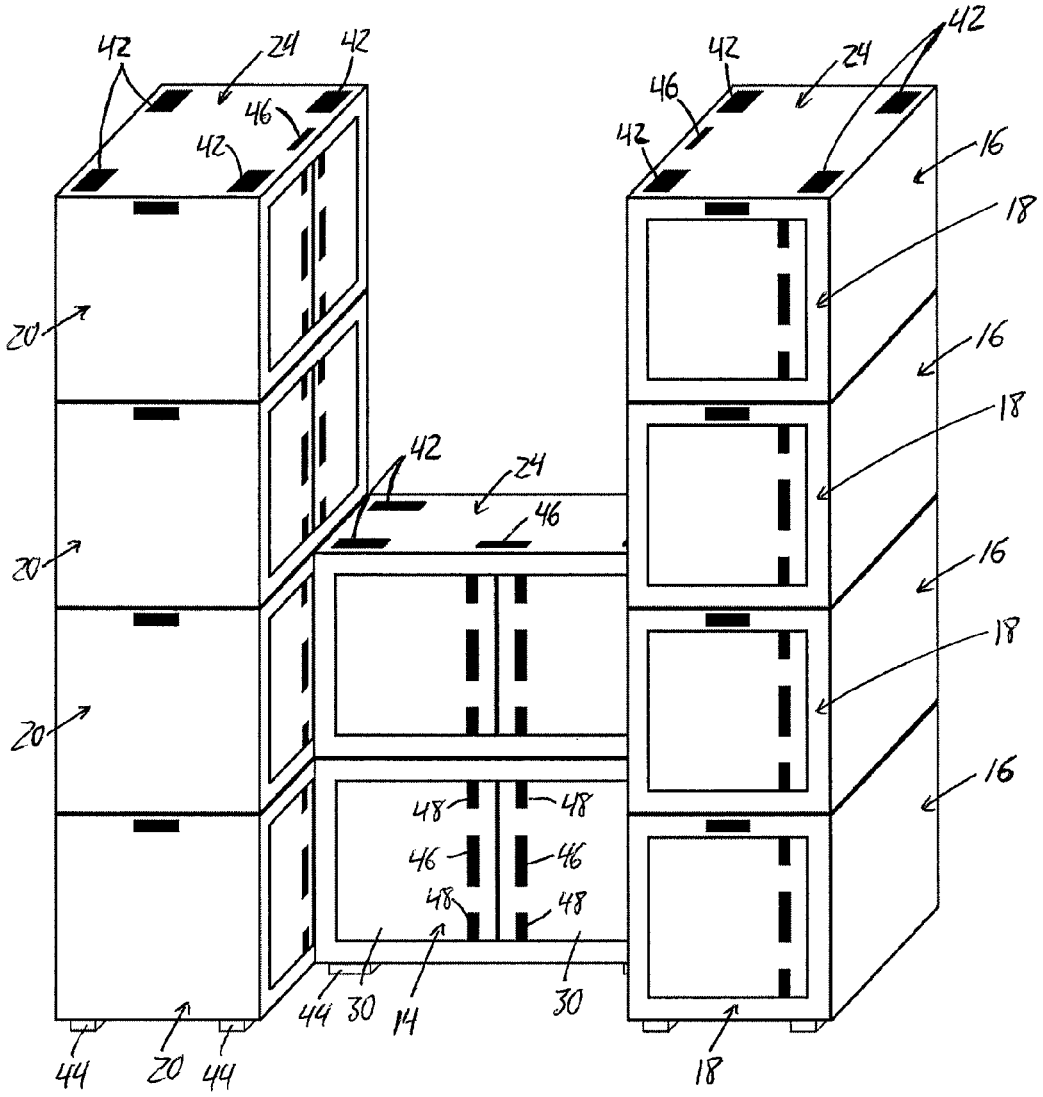
FIG. 3 is a perspective view illustrating use of ten container modules in a stacked multi-level configuration featuring two U-shaped levels of the type shown in FIG. 2, and an additional four container modules stacked in two additional levels thereatop.

While FIG. 2 illustrates a two-dimensional single-level layout of container modules, FIG. 3 illustrates a three-dimensional multiple-level configuration of container modules, thereby providing greater storage capacity, while at the same time still using flat-side mating of the modules together into a compact space-efficient footprint and employing the multiple door design of the container modules to enable access to the interior space of each and every container module regardless of whether one or more of its doors are obstructed by another module situated beside or atop the module concerned. The illustrated configuration also illustrates creation of an available working space atop a reduced-height stack of modules that is lesser in number than one or more adjacent stacks of modules. In the illustrated four-level configuration, the two lower levels employ a U-shaped layout like that of FIG. 2, while the two upper levels each lack a module at the center of the U-shaped layout of the lower levels, whereby the lid 24 of the uppermost center module 10*d* can be used as a table-like workspace, for example for temporary placement of one or more objects thereon during retrieval of objects from the modules, or during placement of objects within the modules.

Figure 11:
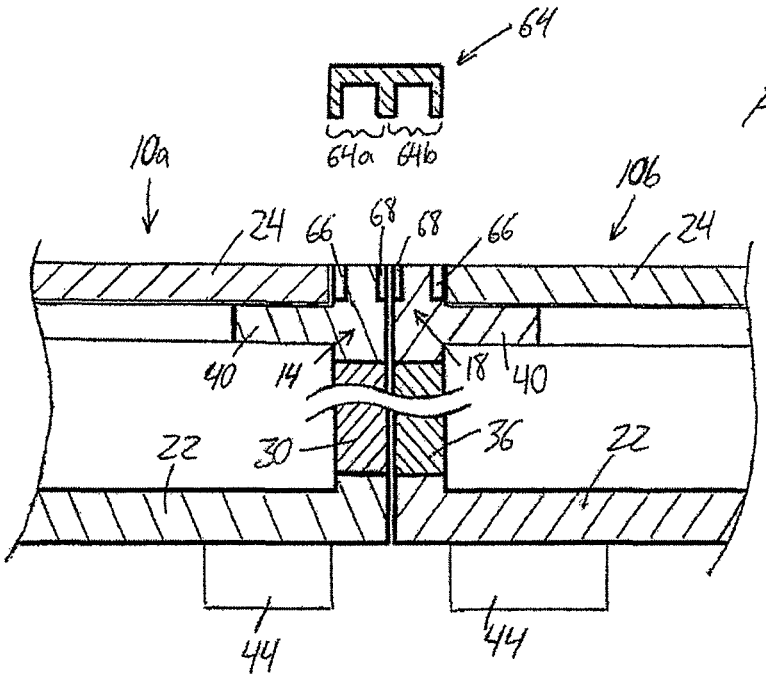
FIG. 11 is partial cross-sectional view schematically illustrating a clipped connection between two of the container modules in FIG. 2, as viewed along line XI-XI thereof.

The adjacent modules in FIG. 2, and in the two lower levels of FIG. 3, are secured together by clips 64, one of which is shown in more detail in the cross-sectional view of FIG. 11. The clip has a downward-opening double-U shape that embraces over the upward facing top edges of the adjacently positioned and abutted-together walls 14, 18 of the two container modules 10*a*, 10*b* in order to hook the two container modules together and prevent separation thereof at these adjacent walls 14, 18. At a half-way point along the length of each end wall of each container module, and at one-quarter and three-quarter distances along the length of each side wall of each module, the respective wall features an inside groove 66 extending downward from the top edge of the wall on the inside thereof, and a corresponding outside groove 68 extending downward from the top edge of the wall on the outside thereof. Accordingly, the pair of grooves 66, 68 on the first container module 10*a* of FIGS. 2 and 11 are centrally located over one of the side doors 30 thereof, while the grooves 66, 68 on the second container module 10*b* of FIGS. 2 and 11 are centrally located over the end door 36 thereof. The double-U shape of the clip 64 features a first downward-opening (or inverted) "U" 64*a*, whose parallel downward-extending legs slide downward into the grooves 66, 68 of the first module 10*a*, and a second downward-opening "U" 64*b*, whose parallel downward-extending legs slide downward into the grooves 66, 68 of the second module 10*b* such that each downward-opening (or inverted) "U" embraces over the top edge of the wall 14, 18 of the respective container module.

As shown, the first "U" 64*a* and second "U" 64*b* may share a common center-leg of the double-U shaped clip 64. In another embodiment, the clip may have a singular-U shape of wider extent between its two legs, whereby the clip would embrace collectively over the two walls from the inside groove 66 of one wall to the inside groove 66 of the other wall without individually embracing the two walls. In such instance, the singular-U shape of such a clip would not reach downwardly between the two walls, in which case the outer grooves 68, may be omitted.

With the end wall of each module being half as long as the side walls, one set of grooves being positioned half way along each end wall, and two sets of grooves being positioned at one-quarter and three-quarter positions along each side wall, two container modules can be clipped together end-to-end, side-to-side or end-to-side. When two modules are clipped together end-to-end, the two side walls of each module are respectively coplanar with the side walls of the other module. When two modules are clipped together side-to-side, since each side wall has two sets of clip-accommodating grooves, the two modules may be aligned with one another in order to place each end wall of each module coplanar with a respective end wall of the other module, or may be offset from one another so that one end wall of each module resides at a vertical mid-plane of the other module at a half way point between the two end walls thereof. When two container modules are clipped together end-to-side so as to lie perpendicular to one another, the container module that is being clipped at its end wall (i.e. the "end-clipped" container module) will have one of its side walls coplanar with one end wall of the other "side-clipped" container module. The particular end-wall of the side-clipped container module at which the end-clipped container module will reside will depend on which of the two available clip-accommodating sites on the side wall of the side-clipped module was selected by the user as the coupling site at which the two container modules will be coupled.

The clip-accommodating sites defined by the grooves in the container module walls, together with the flat exterior of each container module on all sides thereof and the accessibility of the interior space of each container module from the side, end and top thereof, therefore allows for a multitude of possible configurations of stacked and clipped-together container modules. This flexibility allows the system to be configured in order to suit particular storage needs, and in order to suit rooms or environments of different size and shape constraints. The depth of each inside groove 66 in the thickness direction of the respective module wall preferably equals or slightly exceeds the thickness of the respective outer leg of the clip 64 so that the clip does not project beyond the inside surface of the respective wall and interfere with closing of the module lid 24.

To enable convenient transport, stacking and unstacking of the modules, each container module features two carrying handles 70, each recessed into one of the two end walls 18, 20. In the case of the door-equipped end wall 18, the recessed carrying handle 70 is situated in the upper part of the frame 32 that borders the topside of the end door 36. The other carrying handle 70 in the opposing end wall 20 is positioned in a matching position near the top of the wall at a midpoint of the end wall's length.

Figure 9:
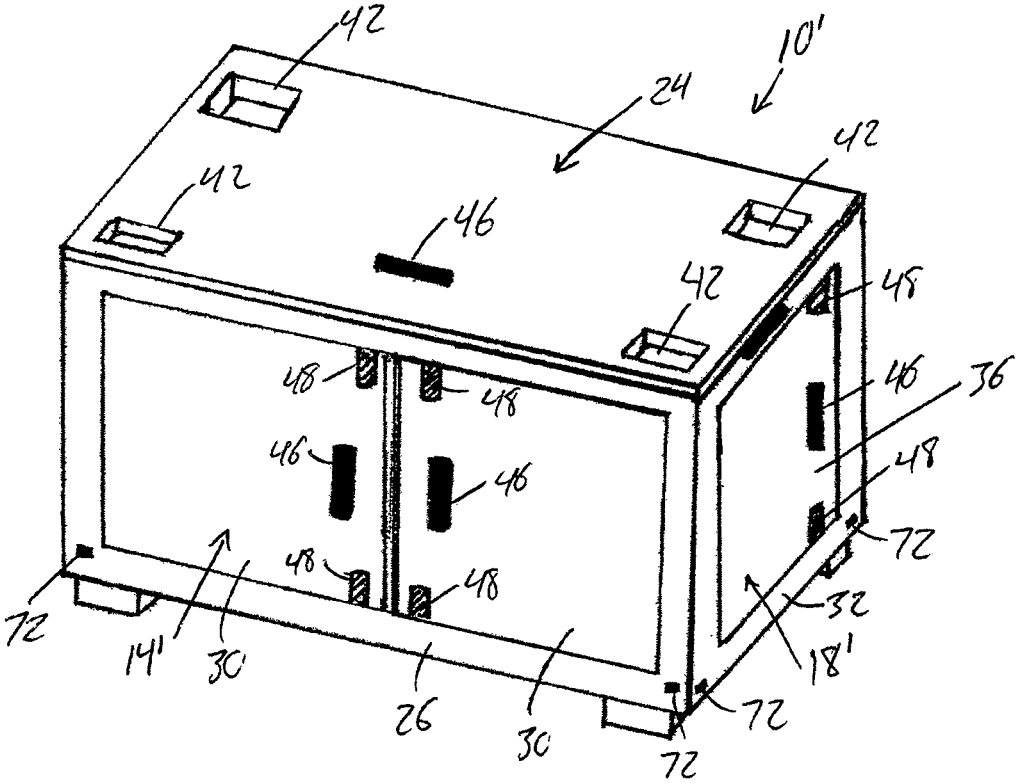
FIG. 9 is a perspective view of a user-assembled version of the container module of FIG. 1.

The container modules of the present invention may be pre-assembled by a manufacturer or distributor prior to sale or delivery to the consumer. However, to enable more compact and efficient storage and transport, each module may alternatively be provided as a flat-pack kit of parts to be assembled by the consumer. On such flat-pack module design is described as follows with reference to FIGS. 9 and 10, of which FIG. 9 shows an assembled flat-pack module 10' and FIGS. 10A through 10H show flat-pack panels from which the module may be assembled.

Figure 10I:
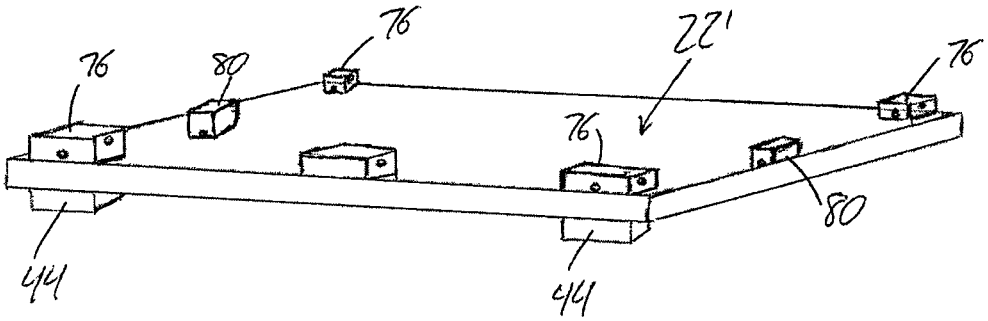
FIG. 10I is a perspective view of a variation of the bottom wall panel of FIGS. 10G and 10H.

FIGS. 10C and 10E show a doorless side wall panel 16' for defining the doorless second side wall of the assembled container module 10'. The doorless side wall panel 16' is a flat rectangular panel having two fastener openings 72 therein near the two bottom corners of the panel. A pair of block-shaped stops 74 project from the inner side of the panel that faces into the interior space of the container in the module's final assembled state near the two upper corners of the panel. These stops 74 are an alternative to the flange-like inner rim 40 that juts inwardly from the side and end walls of the pre-assembled container module 10 of FIG. 5, and thus enable seating of the closed lid 24 atop these stops 74 in the final assembled state of the flat-pack container module 10'. A door-equipped side wall panel 14' has the same rectangular outer perimeter, fastener openings 72 and stop blocks 74 as the doorless side wall panel 16', but instead of a solid rectangular panel features a rectangular door frame 26 delimiting the opening in which the two side doors 30 are pivotally mounted, for example by pivot pins projecting from top and bottom edges of each side door into the top and bottom parts of the frame 26. A door-equipped end wall panel 18' likewise features a rectangular door frame 32 delimiting a door opening in which the single end door 36 is pivotally mounted, and again features the same fastener holes and stop blocks 74 near the lower and upper corners of the frame 32, but is smaller than the door-equipped side wall panel 14' so as to the define the first door-equipped end wall of the assembled module. A doorless end wall panel 20' is a solid rectangular panel like the doorless side wall panel 16', again featuring stop blocks 74 and fastener holes 72, but being smaller in size than the doorless side wall panel so as to define the second doorless end wall of the assembled module.

A bottom wall panel 22' of the flat-pack container module 10' features a solid rectangular panel defining the floor of the container, four block-shaped feet 44 of the type described above for the preassembled module 10 at the underside of the panel 22', and four raised, block-shaped fastening bodies 76 protruding upward from an otherwise flat upper surface of the bottom wall panel that defines the floor of the assembled module's interior space. The four fastening bodies 76 are situated near the four corners of the bottom wall panel, therefore residing adjacent to the perimeter of the bottom wall panel at spaced apart positions therearound. A predefined fastener hole 78 is pre-drilled or tapped into each fastening body by the manufacturer at outward facing sides thereof that face toward a respective end and side of the rectangular bottom wall panel. At each end of the bottom wall panel, one of the end wall panels is erected atop the bottom wall panel at an edge-adjacent area thereof between the respective end of the bottom wall panel and the pair of fastening blocks adjacent that end of the bottom wall panel. The end wall panel is fixed in this erected position by driving threaded fasteners through the fastener holes 72 of the end panel and into the pre-defined fastener holes 78 of the two fastening bodies 76. Likewise, at each side of the bottom wall panel, one of the side wall panels is erected atop the bottom wall panel at an edge-adjacent area thereof between the respective perimeter side of the bottom wall panel and the pair of fastening blocks adjacent that end of the bottom wall panel, and the side wall panel is fixed in this erected position by driving threaded fasteners through the fastener holes 72 of the side wall panel and into the pre-defined holes 78 of the two fastening bodies 76.

In the flat-pack design, the lid 24 may be pre-attached to one of the side-wall panels by a suitable hinge that enables the lid 24 to lie flat against the side wall panel prior to assembly of the module. Alternatively, the lid 24 may initially be provided as a separate piece that is to be fastened in place by the consumer during assembly of the module. While the use of block-shaped stops 74 reduces material requirements to accommodate seating of the closed lid of the final assembled module, longer flanges may be employed to instead form a rim-like lid support like the inner rim 40 of the preassembled module shown in FIG. 5. FIG. 10E shows a variation of the bottom wall panel 22' which, in addition to the raised fastening bodies 76 at the four corners of the panel, also features a central block-shaped stop 80 positioned in line between a respective pair of the fastening bodies near some or all of the perimeter edges of the bottom wall panel. These block-shaped stops 80 further reinforce the erected walls, and/or provide a door stop that blocks movement of the side doors and/or end door past their closed positions.

Figure 4:
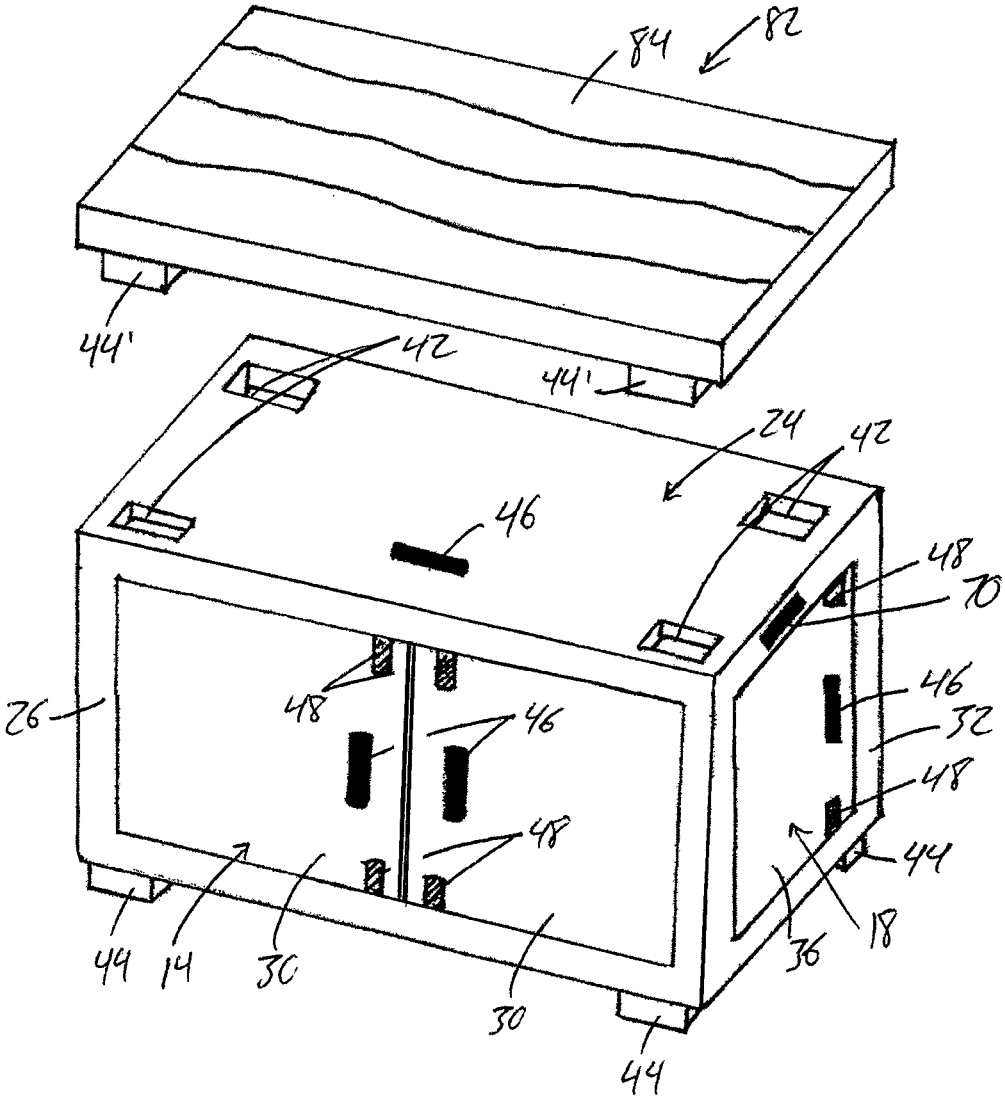
FIG. 4 is a perspective view of the single container module of FIG. 1 together with an optional tabletop unit stackable thereatop.

FIG. 4 illustrates an optional table-top module 82 that may accompany a set of container modules as part of a modular storage system. The table-top module features a slab or panel 84 having a flat upper surface and an opposing flat lower surface parallel thereto. A set of foot members 44' are affixed to the lower surface of the slab or panel 84 and project downwardly therefrom near the corners thereof for selective insertion of the foot members 44' into the lid recesses 42 of one of the container modules. In occupying these lid recesses 42, the foot members 44' support the tabletop module 82 in a positioned stacked atop said one of the container modules to create a flat, uninterrupted working surface spanning the full lid area of the underlying container modules.

Figure 6:
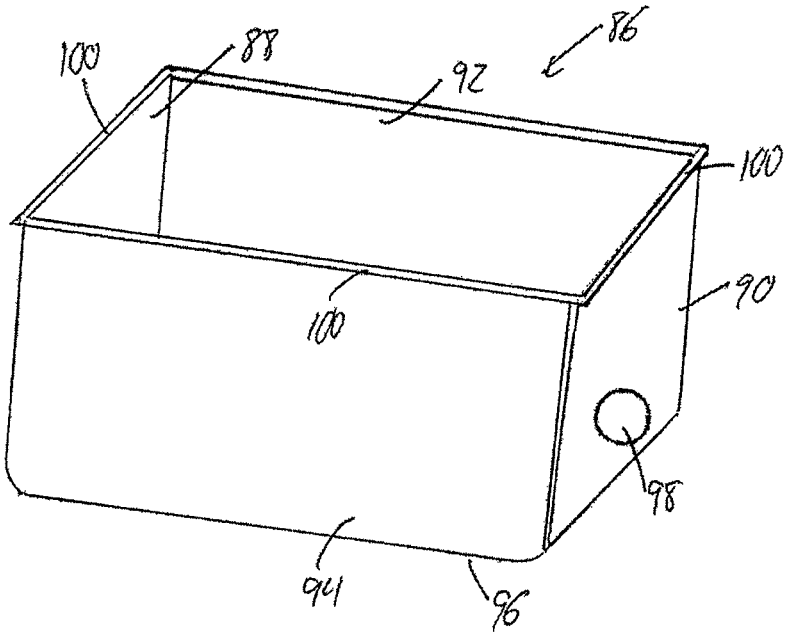
FIG. 6 is a perspective view of an optional cooler tray insert for the single container module of FIG. 1.

FIG. 6 shows a plastic cooler insert 86 that may accompany a set of container modules as part of a modular storage system. The cooler insert 86 has opposing first and second walls 88, 90 for internally lining the end walls 18, 20 of one of the container modules, opposing third and fourth walls 92, 94 for internally lining the side walls 14, 16 of the container module, and a fifth wall 96 spanning between the first four walls 88-94 at lower ends so that the five walls cooperatively define a tray-shaped insert that can be placed in any one of the container modules. An openable/closeable drain port 98 is provided in at least one wall of the cooler insert 86. The cooler insert 86 is sized for placement within the rectangular interior volume of the container module in a position lining interior surfaces of the container module's walls 14-22. An open upper end of the cooler insert is accessible by opening the lid 24 of the container module. The container module and the cooler insert thereby collectively form a cooler for storage of ice-cooled food or beverage items within the cooler insert while maintaining the end walls, the side walls and the bottom wall in a dry state isolated from the ice. As shown, the cooler insert 86 features out-turned flanges 100 on all sides of the insert at an upper end thereof for catching over the inner rim 40 of the module.

Figure 7:
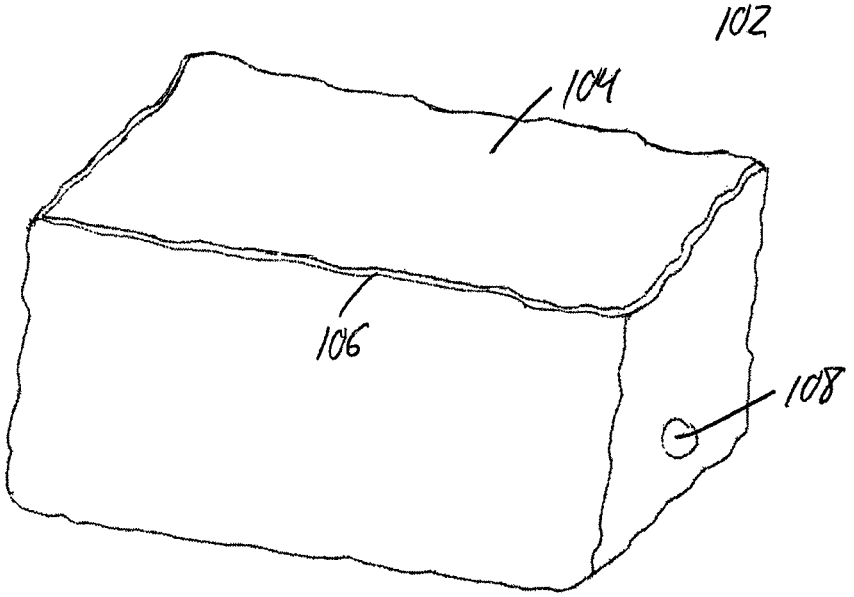
FIG. 7 is a perspective view of an optional zipper seal vacuum bag insert for the single container module of FIG. 1.

FIG. 7 shows an openable/closeable vacuum seal bag 102 that may accompany a set of container modules as part of a modular storage system. In an expanded state, the bag 102 has a four rectangular perimeter wall panels cooperating with a floor panel and an openable closeable flap panel 104 to enclose a predetermined rectangular volume that is similar in size to the interior volume of each container module 10. The bag, in its expanded state, will therefore occupy a substantial entirety of said interior volume of the container module. A zipper seal 106 is provided between the flap panel 104 and the perimeter wall panels on three sides of the top flap. A fourth side of the flap panel 104 is seamlessly integral with the fourth perimeter wall of the bag to form an integral extension thereof, whereby this integral connection between the flap and the fourth perimeter wall forms a living hinge by which the flap 104 is movable in a generally pivotal manner to open and close the bag 102 at its upper end. In its closed state, the zipper seal acts to seal off the interior of the bag 102 from the surrounding environment in an air-tight state. A vacuum port 108 is provided in one of the panels to enable connection of a vacuum source to the port in a manner communicating with the bag's interior, whereby activation of the vacuum source will draw air out of the bag, causing the bag to collapse into tight conformance with its contents for air-tight storage of said contents within the bag. This enables storage of perishables in one or more container modules an air-tight state to increase the shelf life thereof, and/or storage of clothing or other fabric articles within a container module in a compacted, space efficient condition constrained by the vacuum-collapsed bag.

Figure 8:
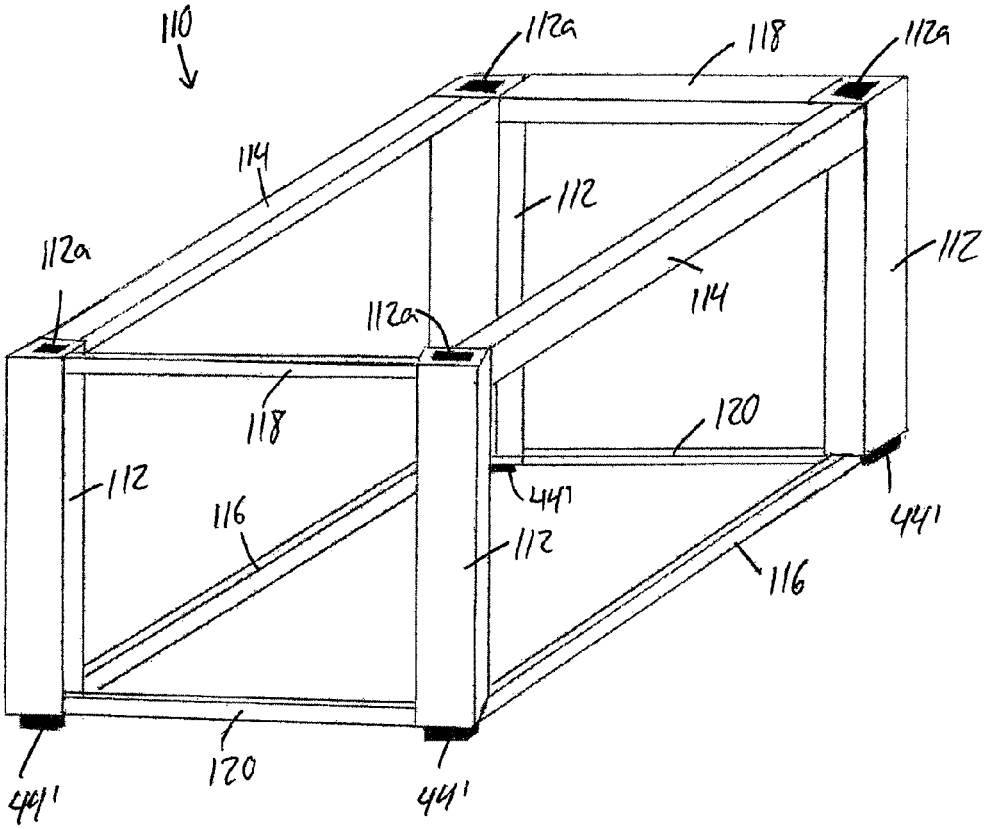
FIG. 8 is a perspective view of open skeletal shelving rack module that is stackable with the single container module of FIG. 1.

FIG. 8 shows an optional shelving rack module 110 that may accompany a set of container modules as part of a modular storage system. The rack module has a skeletal frame of rectangular shape. The skeletal frame has vertically upright frame members 112 at four corners thereof, top and bottom side members 114, 116 running perpendicularly between two of the upright frame members on each of two opposing sides of the rack unit, and top and bottom end members 118, 120 running perpendicularly between two of the upright frame members at each of two opposing ends of the rack unit. Each side of the rack is equal or similar in length to the opposing sides of each container module, and each end of the rack is equal or similar in length to the opposing ends of each container module. The rack module 110 is stackable with each container module. More specifically, the center-to-center distance between the two upright frame members 112 on each side of the rack unit equals the center-to-center distance between the two lid recesses 42 on each side of each container module 10. Likewise, the center-to-center distance between the two upright frame members 112 at each end of the rack unit equals the center-to-center distance between the two lid recesses 42 at each end of each container module 10. Each upright frame member is a piece of rectangular tubing whose hollow interior 112*a* is of sufficient cross-sectional area to accommodate receipt of the feet 44 of any container module 10 within the open upper end of the frame member's hollow interior 112*a* in order to seat said container module atop the rack unit. A foot member 44" is attached to the lower end of each upright frame member 112 and has a lesser cross-sectional area than the hollow interior 112*a* of the upright frame member in planes normal to the longitudinal axis of the upright frame member so that the foot members 44' of the rack unit 110 are receivable in the open upper ends of the upright frame members 112 of another rack unit 110, and are likewise receivable in the lid recesses 42 of any of the container modules.

Figure 8A:
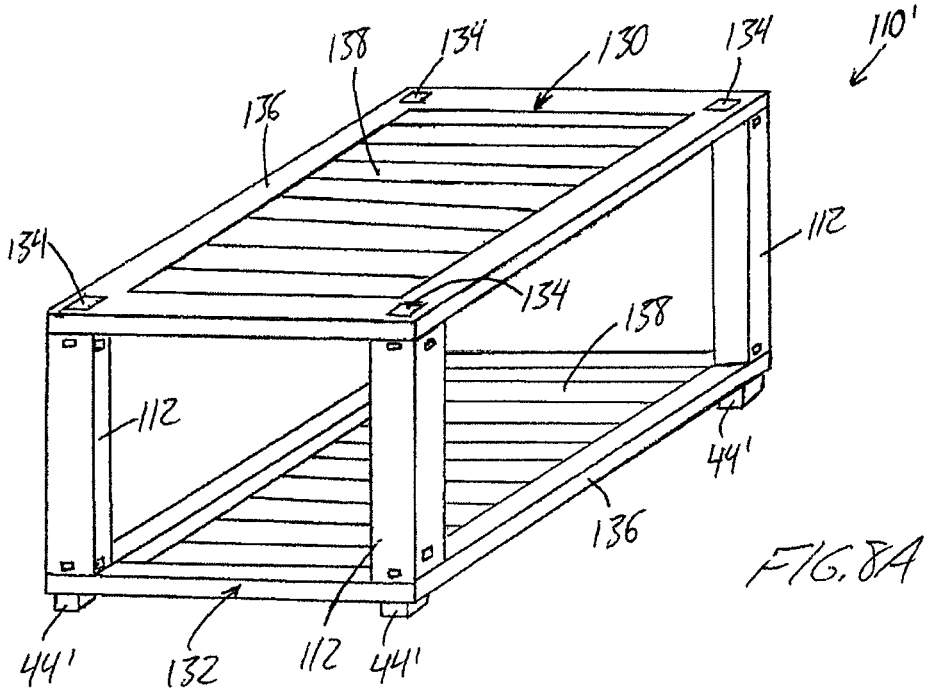
FIG. 8A is a perspective view of a top and bottom plated shelving rack module that is stackable with the container module of FIG. 1 and/or the open skeletal shelving rack module of FIG. 8.

Like the feet 44 of the container modules, the foot members 44' are sized and shaped for mating cooperation with the lid-recesses to limit relative movement between the modules (including the container modules and rack modules) when stacked atop one another, thereby providing stability to the stacked modules. The rack can be used as the lowest module in a stack, for example to elevate one or more container modules upwardly from a ground surface, e.g. to prevent exposure of contents of the storage container to potential flood waters or other ground-level contaminants. The rack module 110 can also be used anywhere else in a stack of modules, e.g. to provide more open access to frequently needed articles or to accommodate larger articles that won't fit within the enclosed space of the container modules. The open skeletal structure of the rack unit enables longer articles to be laid across the rail-like side and end members and to project beyond the sides or ends of FIG. 8A shows a first variant of the rack module of FIG. 8, which instead of a fully open skeletal structure that is open on all six sides, is closed off on its top and bottom sides by upper and lower plates 130, 132 that both span between the four upright frame members 112 at the corners of the module. The plated rack 110' however remains open at the four remaining sides to provide horizontal access to the storage space delimited between the upper and lower plates 130, 132. The upper plate 130, near each of its four corners, features a respective opening 134 for receiving the respective foot 44/44' of another container or rack module. The lower plate 132, near each of its four corners features a respective foot 44' just like the open skeletal rack of FIG. 8.

The four doorless open sides of the plated rack module 110' allow storage of articles that won't fit within a container module by allowing such articles to overhang one or both of two opposing sides of the plated module 110', but provides improved flexibility over the open skeletal rack 110 of FIG. 8 by also allowing storage of articles that wouldn't fully span between two opposing sides of the rack, as such articles can simply be seated on the bottom panel 132 of the plated rack 110'. Articles can also be seated on the top panel 130 of the plated rack 110' if another module is not stacked atop same. The four open sides allow convenient doorless access to frequently needed items. The upper and lower plates 130 may each have an outer perimeter area 136 of thicker and/or materially distinct composition of greater rigidity than a central area 138 of the plate, whereby the more robust outer perimeter areas of the plates serve to define functional equivalents of the side and end members 114, 116, 118, 120 of the skeletal rack module 110 of FIG. 8, which rigidly maintain the rectangular form of the module by holding the upright frame members 112 at fixed distances from one another. Alternatively, the plated rack module 110' may feature the same side and end members of the skeletal rack module, with upper and lower plates of uniform or non-uniform composition and/or cross-section affixed to such separately formed frame members.

Figure 8B:
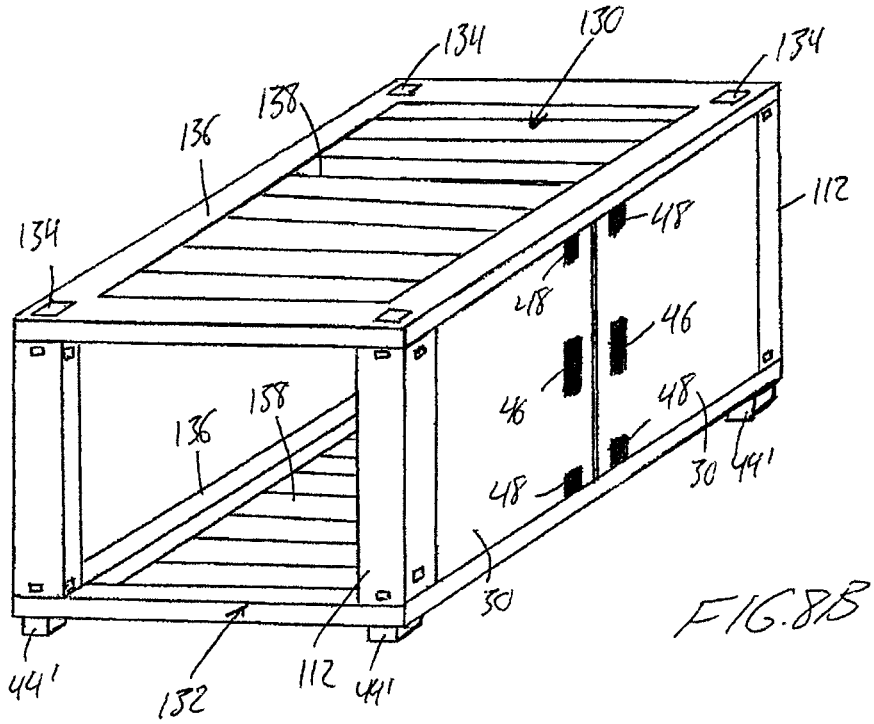
FIG. 8B is a perspective view of a door-equipped shelving rack module that is stackable with the container module of FIG. 1 and/or the shelving rack module of FIG. 8 and/or FIG. 8A.

FIG. 8B shows a further variant of the rack module, which adds a pair of side doors 30 to one of the two longer sides of the plated rack module 110' of FIG. 8A, while leaving the three remaining doorless sides of the rack module open. The door-equipped rack module 110" allows storage of items that exceed the interior length of the rack module between the two ends thereof by allowing these items to reach externally outward from the module at the two ends thereof, for example into adjacent door-equipped modules with matching open ends, while allowing concealment of these long items behind the side doors 30 when closed. Shorter articles may also be stored atop the lower plate 132 within the storage space of the rack module between the upper and lower plates and behind the closed side doors 30. As shown, the doors 30 may feature the same recessed handles 46 and recessed locking mechanisms as the doors of the container modules.

In brief summary of the disclosed invention, a portable storage container system is designed with a modular, customizable configuration. Each container module consists of a six-sided rectangular box shape. Three sides of the six total sides have opening doors, for a total of four doors altogether. Three of the four doors are side mounted on the rectangular box (one set of double doors at one of the longer sides of the box, and one single door at one of the shorter sides or ends of the box). The top of the rectangular box has a lid acting as the fourth door. This lid/door has a set of four female recessed pockets to allow for a second storage container to securely fit onto it by way of four corresponding feet provided on the bottom of each container. There are four filler units, e.g. plastic blocks, that fill the female pockets if the storage container is not required for use in a stacked manner. All doors are secured by recessed pivot hinge mechanisms so as to avoid any protruding parts at the flat sides of the container. Each door has a recessed pocket acting as the door opening mechanism or handle. The doors may be configured to open left or right. The doors incorporate recessed "sliding thumb" door pins to secure the doors so that shifting contents will not force the doors open during transportation.

Each storage container is preferably accompanied by six double-U shaped clips, which may be formed of metal or plastic for example. When the storage containers are aligned horizontally, these double-U shaped clips slide into predefined (e.g. machined or molded) grooves in the upper section of each container. These clips give the storage system additional structural support with respect to horizontal pull forces that might otherwise cause separation between adjacent container modules.

Each container module sits on bottom legs or feet, for example in the form of square or rectangular male protrusions. These male protrusions act as stabilizers for horizontal and vertical forces when the containers are positioned in a stacked system. If the container is on the bottom of the stack, these male protrusions raise the base of the container off the ground allowing for easy access to a dolly for easy transportation. The container modules may also be accompanied plastic shims, which allow the containers to be adjusted to sit level on the ground. The container may be comprised of various materials, including plastic or lightweight metals, or a combination of such materials. The straight lines and non-protruding features of the container allow the system "fit" together in a structural sound and efficient manner, similar to building blocks, which also makes it customizable and configurable.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A modular storage system comprising:

a plurality of container modules each comprising a container having:

opposed first and second end walls at opposing ends of the container;

opposed first and second side walls perpendicularly interconnecting the first and second end walls at opposing sides of the container and with said end walls to delimit a rectangular area between said end walls and said side walls, the side walls being longer than the end walls in a direction around a perimeter of the rectangular area;

a bottom wall spanning between the end walls and the side walls at lower ends of said end walls and said side walls; and a top wall residing opposite the bottom wall at a topside of the container and spanning between the end walls and the side walls at upper ends of said end walls and said side walls to cooperate with the bottom wall and the first, second, third and fourth side walls to delimit a rectangular interior volume of the container;

the first end wall comprising an end door movable between open and closed positions respectively opening and closing an end door opening that is located at a respective one of the opposing ends of the container to enable access to the interior volume of the container through said end door opening when said end door is in the open position, said end door opening spanning a majority area of the first end wall;

the first side wall comprising at least one side door movable between open and closed conditions respectively opening and closing a side door opening that is located at a respective one of the opposing sides of the container to enable access to the interior volume of the container through said side door opening when said at least one side door is in the open condition, said side door opening being wider than said end door opening in the direction around the perimeter of the rectangular area, said side door opening spanning a majority area of the first side wall; and the top wall comprising a lid movable between open and closed states respectively opening and closing a lid opening located at the topside of the container to enable access to the interior volume of the container through said lid opening when said lid in the open state, said lid opening spanning a majority area of the top wall of the container;

wherein the rectangular interior volume of each module is accessible via the side door regardless of an obstructed or accessible status of the lid and the end door, is accessible via the end door regardless of an obstructed or accessible status of the lid and the side door, and is accessible via the lid regardless of an obstructed or accessible status of the side door and the end door.

2. The modular storage system of claim 1 further comprising at least one rack module comprising a rectangular skeletal frame having upright frame members at four corners thereof, top and bottom side members running perpendicularly between two of the upright frame members on each of two opposing sides of the rack module, and top and bottom end members running perpendicularly between two of the upright frame members at each of two opposing ends of the rack module, each side of the rack being equal or similar in length to the opposing sides of each module and each end of the rack being equal or similar in length to the opposing ends of each module, whereby the rack module is stackable with each module with the four upright frame members of the rack module in general alignment with four corners of the module at which the end walls and side walls of the module meet.

3. The modular storage system of claim 1 wherein the top wall has four corners and a set of recesses opening into the top wall at an exterior side thereof at respective locations situated proximate the four corners of the top wall, and the bottom wall has four corners and a set of protruding feet on an exterior surface of the bottom wall at respective sites situated proximate the four corners of the bottom wall, the set of recesses and the set of protruding feet having aligned positions and matable sizes to enable stacking of the container modules atop one another with the protruding feet of one container module received in the recessed of another container module.

4. The modular storage system of claim 3 further comprising at least one rack module comprising a rectangular skeleton frame having upright frame members at four corners thereof, top and bottom side members running perpendicularly between two of the upright frame members on each of two opposing sides of the rack unit, and top and bottom end members running perpendicularly between two of the upright frame members at each of two opposing ends of the rack unit, each side of the rack being equal or similar in length to the opposing sides of each container module and each end of the rack being equal or similar in length to the opposing ends of each container module, the upright frame members having openings at top ends thereof that are sized for receipt of the protruding feet of any one of the container modules and bottom elements that are sized for receipt thereof within the recesses of said any one of the container modules, thereby enabling stacking of the rack module above or below said any one of the container modules.

5. The modular storage system of claim 4 wherein the upright frame members of the rack unit comprise tubing members, hollow interiors of which define the openings at the top ends of said upright frame members, and the bottom elements comprise foot members that have lesser cross-sectional area than said tubing members and that are attached to bottom ends of said tubing members.

6. The modular storage system of claim 3 comprising at least one set of filler units of similar shape and size to the set of recesses in each container module for selective insertion of said set of filler units into the recesses of one of the container modules to occupy said recesses during non-stacking use of said one of the container modules.

7. The modular storage system of claim 3 comprising at least one tabletop module having a flat upper surface and an opposing lower surface, and a set of foot members for selective insertion of said set of foot members into the recesses of one of the container modules to occupy said recesses and support the tabletop module in a positioned stacked atop said one of the container modules.

8. The modular storage system of claim 1 wherein the end door and the at least one side door comprise flat exterior faces free of any projecting features jutting outward therefrom to enable flush side-to-side, end-to-end and end-to-side placement of adjacent container modules with one another.

9. The modular storage system of claim 8 wherein the end door and the at least one side door comprise recessed handles.

10. The modular storage system of claim 8 wherein the end door and the at least one side door comprise movable locking members mounted in recessed areas accessible from outside the container and movable between locked positions engaging with frames of the first end wall and first side wall that close around the end wall opening and the side wall opening, and unlocked positions disengaged from said frames to enable locking and unlocking of said end door and said at least one side door.

11. The modular storage system of claim 10 wherein the movable locking members comprise slidable thumb latches.

12. The modular storage system of claim 1 wherein the second end wall and the second side wall are free of any openable and closable doors.

13. The modular storage system of claim 1 further comprising clips arranged for selecting coupling together of any two of the container modules in side-by-side, end-to-end or end-to-side relation by clipping over respective upward-facing edges of adjacent walls of said two of the container modules.

14. The modular storage system of claim 13 wherein each clip has a double-U shape embracing individually over the respective edge of each of the adjacent walls of said two of the container modules.

15. The modular storage system of claim 13 wherein each module comprises clip-accommodating grooves in the end walls and side walls, said grooves reaching downwardly from the upward facing edges at discrete predetermined positions around the rectangular area bound by said end walls and said side wall, the predetermined positions being such that alignment of a selected first groove on one of said two modules with a selected second groove on the other of said two modules places said modules in a predetermined alignment with one another in which the two modules can be secured by engagement of a respective one of the clips with the selected first and second grooves.

16. The modular storage system of claim 1 further comprising at least one cooler insert sized for placement within the rectangular interior volume of the container in a position lining interior surfaces of the end walls, the side walls and the bottom wall with an open upper end of the cooler insert accessible by opening of the lid of the container module, whereby the container module and the cooler insert form a cooler for ice-cooled storage food or beverage items within said cooler insert while maintaining the end walls, the side walls and the bottom wall in a dry state isolated from the ice.

17. The modular storage system of claim 1 wherein the end walls have flat exteriors, and the container module comprises recessed carry handles recessed into the end walls at the flat exteriors thereof, including a carry handle situated outwardly from the end door in a stationary perimeter-adjacent frame of the first end wall that borders the end door opening therein.

18. The modular storage system of claim 1 wherein the bottom wall is defined by a bottom wall panel that is separate and distinct from the side walls and the end walls, said side walls and said end walls being defined by separate and distinct side wall panels and end-wall panels respectively, the bottom wall panel comprising raised fastening bodies protruding from a flat upper surface of the bottom wall panel that defines a floor of the container's rectangular interior volume at positions adjacent to and spaced around a perimeter of the bottom wall panel, and the side wall panels and the end wall panels are joined to the bottom wall panels by fasteners engaged into the fastening bodies of the bottom wall panel through the side wall panels and the end wall panels near the lower ends thereof.

19. The modular storage system of claim 18 wherein the fastening bodies comprises pre-defined fastener holes and the fasteners comprises threaded fasteners engaged into said pre-defined fastener holes.

20. The modular storage system of claim 18 wherein the fastening bodies comprise four fastening bodies disposed adjacent four corners of the bottom wall panel, each of said four fastening bodies having one of the end wall panels and one of the side wall panels respectively fastened to said fastening body at two different sides of said fastening body.

* * * * *